US005129348A

United States Patent [19]

Rannenberg et al.

[11] Patent Number: 5,129,348

[45] Date of Patent: Jul. 14, 1992

[54] SUBMERGIBLE VEHICLE

[75] Inventors: George C. Rannenberg, Canton, Conn.; Arthur K. Colling, Jr., Monson, Mass.

[73] Assignee: United Technologies Corporation, Hartford, Conn.

[21] Appl. No.: 566,003

[22] Filed: Dec. 27, 1983

[51] Int. Cl.[5] ..... B63G 8/22

[52] U.S. Cl. ..... 114/333; 114/312

[58] Field of Search ..... 114/333, 331, 330, 312

[56] References Cited

U.S. PATENT DOCUMENTS

| | | | |
|---|---|---|---|
| 2,972,972 | 2/1961 | Allen | 114/333 |
| 3,716,009 | 2/1973 | Strickland | 114/333 |
| 3,800,722 | 4/1974 | Lepage | 114/333 |
| 3,860,983 | 1/1975 | Furth et al. | 114/333 X |
| 4,029,034 | 6/1977 | Mason | 114/333 |
| 4,266,500 | 5/1981 | Jurca | 114/333 |

*Primary Examiner*—David H. Brown

[57] ABSTRACT

A submergible vehicle capable of untethered, fixed depth operation is provided with a rigid walled buoyancy chamber (40) adapted for accommodation of varying volumes of water and buoyancy gas. The chamber is provided with a valving system to adjust the volumes of gas and water within the chamber and therefore control the operating depth of the vehicle. Gas is provided by a high pressure source (10) thereof, the gas also serving to positively pressurize a hull (15) of the vehicle to accommodate the compressive loading thereof by water exteriorly of the vehicle.

3 Claims, 3 Drawing Sheets

SUBMERGIBLE VEHICLE

DESCRIPTION

1. Technical Field

This invention relates to a submergible vehicle capable of untethered hovering for long periods of time at fixed depths in a body of water.

2. Background Art

Small undersea vehicles find significant utility in suboceanic mining, as well as in the installation, inspection and retrieval of submerged equipment, and in undersea warfare applications. For maximum effectiveness, in some applications, such vehicles are required to stay submerged for extensive periods of time at precisely controlled depths without a tether.

It has been found that in general, prior art unmanned, suboceanic vehicles are incapable of subsurface hovering at fixed depths without being anchored. Such buoys are generally lighter than the water they displace and therefore, either float on the surface or are held below the surface by a tether anchoring the buoy to the ocean floor. In military applications, a tether is disadvantageous in that it simplifies location and capture of the buoy for an enemy force and prevents transverse movement by a current or a self-contained engine. A tether is disadvantageous in commercial applications because it impedes the use of other vehicles and equipment in the same locale.

While submarines are capable of fixed depth operation, such vehicles employ pumps or vertical thrusters to achieve a desired buoyancy, such apparatus being prohibitively complex and expensive for the applications of the vehicle of this invention.

Certain prior art submergible vehicles have employed gas filled, flexible chambers such as bags or balloons of variable volume to control buoyancy and therefore, the depth of vehicle operation. Such a structure results in undesirable, unstable control characteristics. That is, if such a flexible chambered vehicle strays to a deeper than desired depth, the increased water pressure at that depth reduces the volume of the chamber, the volume of the gas inside the chamber and thus, further reduces the buoyancy of the vehicle. The further the vehicle strays, the greater the decrease in buoyancy and the faster the vehicle leaves the desired hover depth. Likewise, should the vehicle stray to a lesser depth than desired, the decrease in water pressure experienced by the flexible chamber would accelerate the expansion of the enclosure thereby requiring venting of extensive quantities of nonrecoverable gas into the surrounding water to correct the error in buoyancy and return the vehicle to the desired depth. Such inherent characteristic instability is, in control technology, referred to as "positive feedback". It will be appreciated that such vehicles would require a prohibitively extensive supply of gas for the correction of depth errors over a sustained period of vehicle operation.

Other prior art submergible vehicles have used rigid walled buoyancy chambers open at the bottom thereof to the sea in place of flexible walled chambers discussed above. However, the undesirable positive feedback control characteristic noted above is also exhibited by a rigid walled chamber open at any point to the sea.

DISCLOSURE OF INVENTION

It is therefore an object of the present invention to provide an inherently stable, submergible vehicle capable of fixed depth operation without resorting to pumps or similar complex apparatus.

It is another object of the present invention to provide such a vehicle capable of fixed depth operation for sustained periods of time with a minimal requirement of buoyancy gas.

In accordance with the present invention, a submergible vehicle capable of untethered, fixed depth operation is provided with a rigid walled buoyancy chamber which is normally fully sealed to prevent compressibility and expandability of buoyancy gas accommodated within the chamber The chamber is adapted for accommodation of varying volumes of water and buoyancy gas, and to this end, is provided with a valving system to adjust the volumes of gas and water within the chamber and therefore, to control operating depth. Since the chamber is rigid, errors in operating depth do not affect the volume of buoyancy gas within the chamber. Thus, errors in depth due to inaccuracies in neutral buoyancy of the vehicle or due to natural underwater disturbances are not amplified by any positive feedback control characteristics. Therefore, such errors are correctable with a minimal consumption of gas and the length of time during which the vehicle may be operated with a given quantity of stored gas is enhanced. The gas is provided by a high pressure source thereof carried by the vehicle, rendering air pumps and the like, unnecessary. The buoyancy gas also positively pressurizes the vehicle's hull to react to the sea's compressive loading caused by high water pressure on the exterior of the vehicle. This aspect of the present invention contributes to the vehicle's lightness, uncomplicated structure and economy of operation.

BEST MODE FOR CARRYING OUT THE INVENTION AND INDUSTRIAL APPLICABILITY THEREOF

Figure 1:
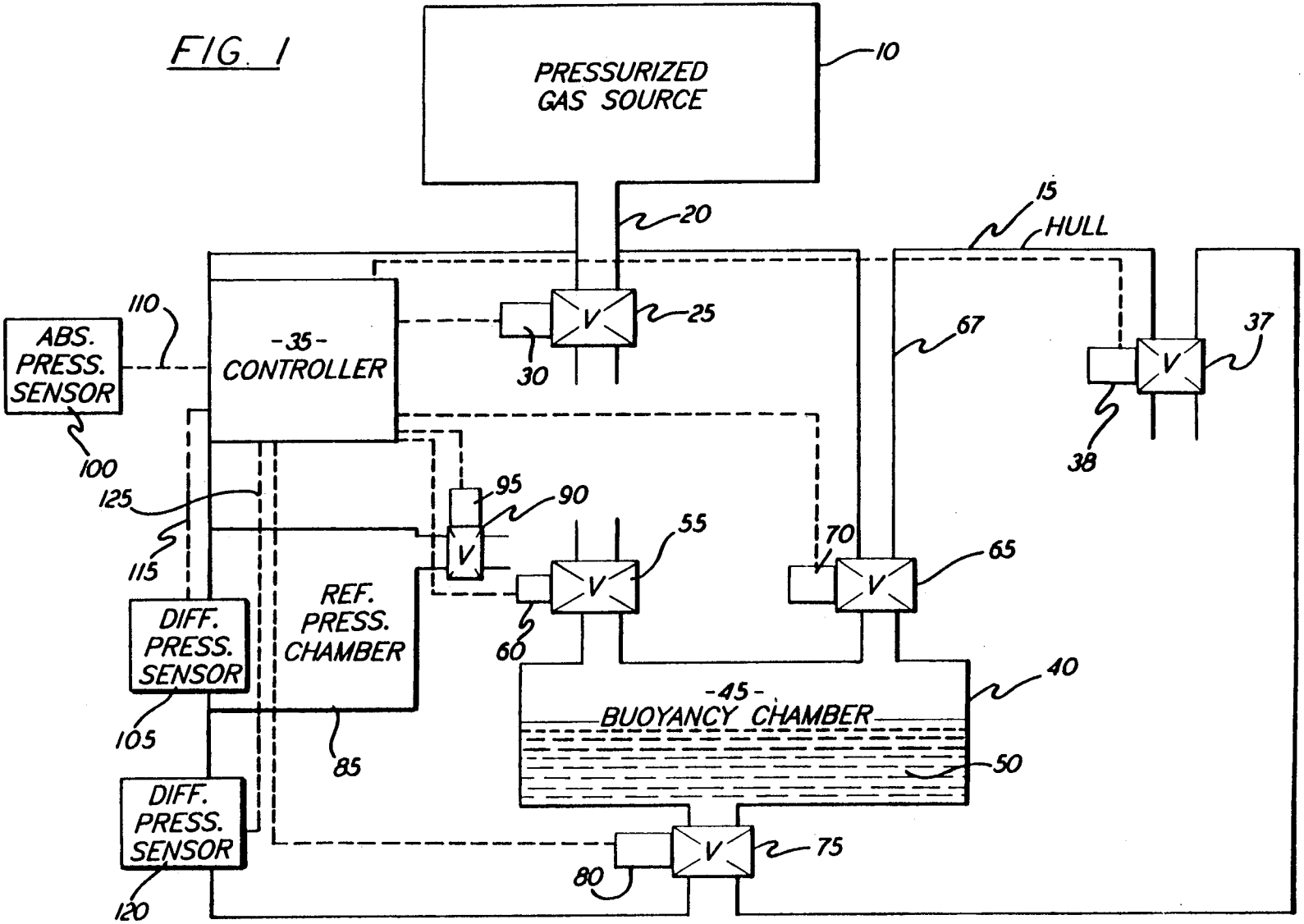
FIG. 1 is a schematic representation of the vehicle of the present invention.

Referring to FIG. 1, the vehicle of the present invention comprises a source of pressurized gas 10 feeding an enclosure (hull) 15 through conduit 20 having pressure regulator 25 disposed therein, regulator 25 being operated by actuator 30. Any suitable gas such as air or nitrogen may be employed. Source 10 may comprise a vessel filled with a stored high pressure gas, or a means for generating gas from a solid or liquid propellant such as gunpowder or hydrazine, respectively. Actuator 30 is operated by controller 35. Pressure regulator 25 lowers the pressure of the gas admitted into enclosure 15 from tank 10 to establish consistency of gas flow downstream of the pressure regulator at given valve settings, and to provide a positive pressure to the interior of enclosure 15 slightly higher than local water pressure to reduce the loads on the enclosure and minimize the required strength of the enclosure walls. Gas is vented from enclosure 15, when required, through valve 37 operated by actuator 38 which is controlled by controller 35.

The vehicle further comprises a rigid walled buoyancy chamber 40 which accommodates a volume of gas 45 and a volume of water 50 therewithin, the proportions of gas volume and water volume determining the buoyancy of the vehicle. Gas is admitted into buoyancy chamber 40 from the interior of enclosure 15 through valve 55, operated by actuator 60 which is controlled by controller 35. Air is vented from buoyancy chamber 40 through valve 65 in conduit 67, this valve veing operated by actuator 70 which is also controlled by controller 35. Water is both admitted into and discharged from buoyancy chamber 40 through valve 75 operated by actuator 80 controlled by controller 35.

Enclosure 15 also houses a reference volume (reference pressure chamber) 85, gas being admitted into the reference volume and discharged therefrom through valve 90 operated by actuator 95, also controlled by controller 35. Controller 35 receives input signals thereto from an absolute pressure sensor 100 which senses the pressure (relative to sea level) of water at the depth of the buoy and from a differential pressure sensor 105 which senses the difference in pressure between the interior of reference volume 85 and the water at the depth of the buoy. Controller 35 also receives an input signal thereto from a differential pressure sensor 120 which senses the difference in pressure between the interior of enclosure 15 and the water at the depth of the buoy. Signals are provided to controller 35 from sensors 100, 105 and 120 throughlines 110, 115 and 125, respectively. The controller is programmed with one or more values of desired operational depths.

Operation of the vehicle is as follows. Assuming for purposes of illustration that the vehicle is submerged at a given depth and operation of the vehicle at a greater depth programmed within controller 35 is desired, the controller compares the value of desired depth with the actual depth sensed by pressure sensor 100 and energizes actuators 70 and 80 to open valves 65 and 75, respectively. Opening valve 65 releases gas 45 from buoyancy chamber 40, the volume of released gas being replaced in the buoyancy chamber by water admitted thereinto through valve 75. The water level in chamber 40 having increased, the buoyancy of the vehicle is reduced and the vehicle descends. As the vehicle descends, the water pressure on enclosure 15 increases and therefore, controller 35 energizes actuator 30 on the basis of the input signal from pressure sensor 120 to adjust pressure regulator 25, admitting more gas into the enclosure to raise the pressure thereof so that it remains slightly higher than the surrounding water pressure to react to the sea's compressive loading of the enclosure exterior. Actuator 38 remains unenergized, holding valve 37 closed so that no gas escapes from the enclosure.

When the vehicle reaches the desired depth, valves 55, 65 and 75 are closed to hold the buoyancy of chamber 40 and thus the buoyancy of the vehicle itself, constant. Closing valves 55, 65 and 75 fully seals the rigid buoyancy chamber thereby obviating positive feedback instabilities characteristic of prior art buoyancy control systems. Valve 37 is closed and pressure regulator 25 is adjusted to hold the pressure internally of enclosure 15 at the desired value.

Assuming that operation of the vehicle at a lesser depth is then desired, controller 35 opens valve 55 whereby additional gas is introduced into chamber 40, valve 75 being held open to allow discharge from chamber 40 of water displaced by the gas. Valve 65 remains closed. The decreased water volume in chamber 40 increases the buoyancy of the vehicle and the vehicle ascends to the desired depth. During such ascention, controller 35 opens valve 37 on the basis of the output of pressure sensor 120, thereby selectively venting enclosure 15 to hold the pressure internally thereof to that of the surrounding water.

For the control of valves 25, 37, 55, 65 and 75 as described hereinabove, controller 35 receives a signal from sensor 100 indicative of absolute water pressure, compares this signal with a preprogrammed value of pressure corresponding to the desired depth, and actuates the valves in the manner described to minimize any error between these signals in any manner well known in the art. The controller may be provided with circuitry to modulate the comparison of the actual and desired pressure (depth) signals with the output of a real-time clock circuit to measure and control vehicle velocity. Such control techniques are well known in the art and are therefore not disclosed in any greater detail herein.

From the description herein it will be understood that for moderate operational depths, vehicle depth may be controlled on the basis of absolute water pressures. However, when extensive operational depths (on the order of several thousand feet) are required, known absolute pressure sensors may not have sufficient accuracy or resolution to locate the vehicle at a desired depth and thereafter to hold the vehicle precisely at that particular depth. Indeed, in certain applications, operation at a depth, within a given range (as determined by sensor accuracy) of a particular reference depth, may be just as acceptable as operation at the exact reference depth. Referring to both FIGS. 1 and 2, the vehicle of the present invention employs a unique control circuit which maintains the vehicle at a constant depth within that range. Referring specifically to FIG. 1, as the vehicle ascends or descends to the reference depth as sensed by absolute pressure sensor 100, controller 35 maintains valve 90 opened by operation of actuator 95. When the vehicle approaches the desired range of the reference depth, valve 90 is closed, trapping a sample of the atmosphere within enclosure 15 inside reference volume 85. As set forth hereinabove, controller 35 maintains the atmosphere within enclosure 15 at a slightly higher pressure than the water pressure at the vehicle depth. Accordingly, at the desired depth, the gas pressure within chamber 85 is slightly higher than that indicated by absolute pressure sensor 100, and a differential pressure sensor 105 sends a signal to controller 35 indicative of this slight difference in pressure.

As set forth hereinabove, small changes in depth pressures which occur as the vehicle strays from its controlled depth are sensed by differential pressure sensor 105 which need only be of a narrow operating range. Inasmuch as absolute pressure sensor 100 is required for determinations that the vehicle is at its reference depth range, sensor 100 could also be used to detect that the vehicle had strayed from its reference depth, thereby avoiding the need for sensor 105. However, sensor 100 must operate over a very large pressure range, from zero depth pressure at sea level to as high as thousands of psi. Therefore, the inherent sensitivity and resolution of sensor 100 in detecting small excursions of the vehicle from its control depth is limited and significantly less than the inherent high resolution and sensitivity of the narrow range differential pressure sensor 105. Inasmuch as the amount of gas required to correct errors in vehicle control depth during a given operational period is inversely proportional to the resolution and sensitivity with which the depth error is detected, the characteristic high resolution and sensitivity of differential sensor 105 enhances the length of time the vehicle can hover at its control depth with a given initial quantity of control gas.

Figure 2:
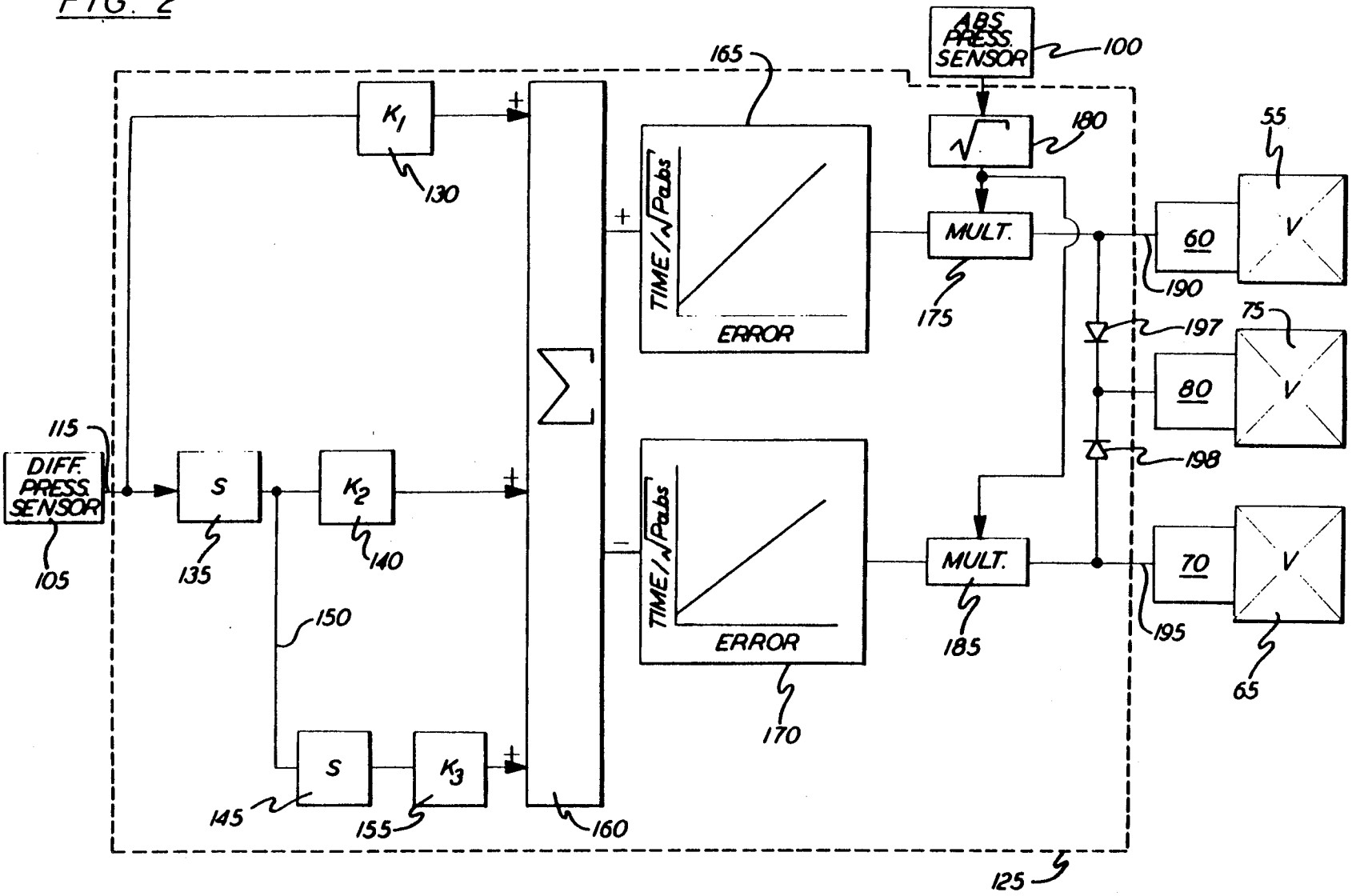
FIG. 2 is a schematic representation of a portion of the control system employed in the vehicle.

Referring to FIG. 2, that portion of controller 35 which controls valves 55, 65 and 75 to maintain the vehicle at a constant control depth is shown within dashed line 125. As illustrated, the output of differential pressure sensor 105 is fed to controller subsystem 125 through line 115. This output signal is fed through line 115 to a multiplier 130 where the signal is multiplied by a first constant $K_1$. The output of pressure sensor 105 is also fed to circuit 135 which differentiates the signal with respect to time, the output of differentiator 135 being fed to multiplier 140 which multiplies this signal by a constant $K_2$. Differentiator 145 in line 150 is fed the output of differentiator 135 and takes the derivative of this signal with respect to time (the second time derivative of the output of pressure sensor 105). The output of differentiator 145 is fed to multiplier 155 where it is multiplied by a third constant $K_3$. Constants $K_1$, $K_2$ and $K_3$ scale the output of pressure sensor 105 and the first and second time derivatives thereof so that these signals may be summed in summing circuit 160. The output of summing circuit 160 is fed to digital data lookup memory or analog function generator 165 if the output is positive in sign, or, if the output is negative in sign, to lookup memory or function generator 170. Function generators 165 and 170 provide output signals of Time of valve opening divided by $\sqrt{P_{abs}}$ as functions of the signals fed to these circuits from summer 160. The output of lookup memory 165 is fed to a multiplier 175. Multiplier 175 is also fed a signal indicative of $\sqrt{P_{abs}}$ from circuit 180 which takes the square root of the absolute pressure signal provided by pressure sensor 100. Multiplier 175 multiplies the two input signals thereto, thereby cancelling the $\sqrt{P_{abs}}$ term from the output of circuit 165. In like manner, multiplier 185 cancels the $\sqrt{P_{abs}}$ term from the output of circuit 170, whereby time signals are fed to actuators 60 and 70 through lines 190 and 195, respectively. Accordingly, it will be seen that a net positive sum of the scaled pressure sensor output signal and the first and second derivatives thereof is converted into a time pulse input signal to actuator 60 thereby opening valve 55 to increase the buoyancy of the vehicle. Similarly, if the sum of the scaled pressure signal and the first and second derivatives thereof is negative in sign, a time pulse signal is fed to actuator 70 to open valve 65 thereby venting gas from chamber 40. Opening either valve 55 or 65 is accompanied by an opening of valve 75 as described hereinabove, diodes 197 and 198 passing a signal to energize actuator 80 whenever actuator 60 or actuator 70 are energized. The simultaneous shutting of valves 55, 65 and 75 seals chamber 40 to prevent positive feedback instabilities exhibited in prior art buoyancy control systems.

Figure 3:
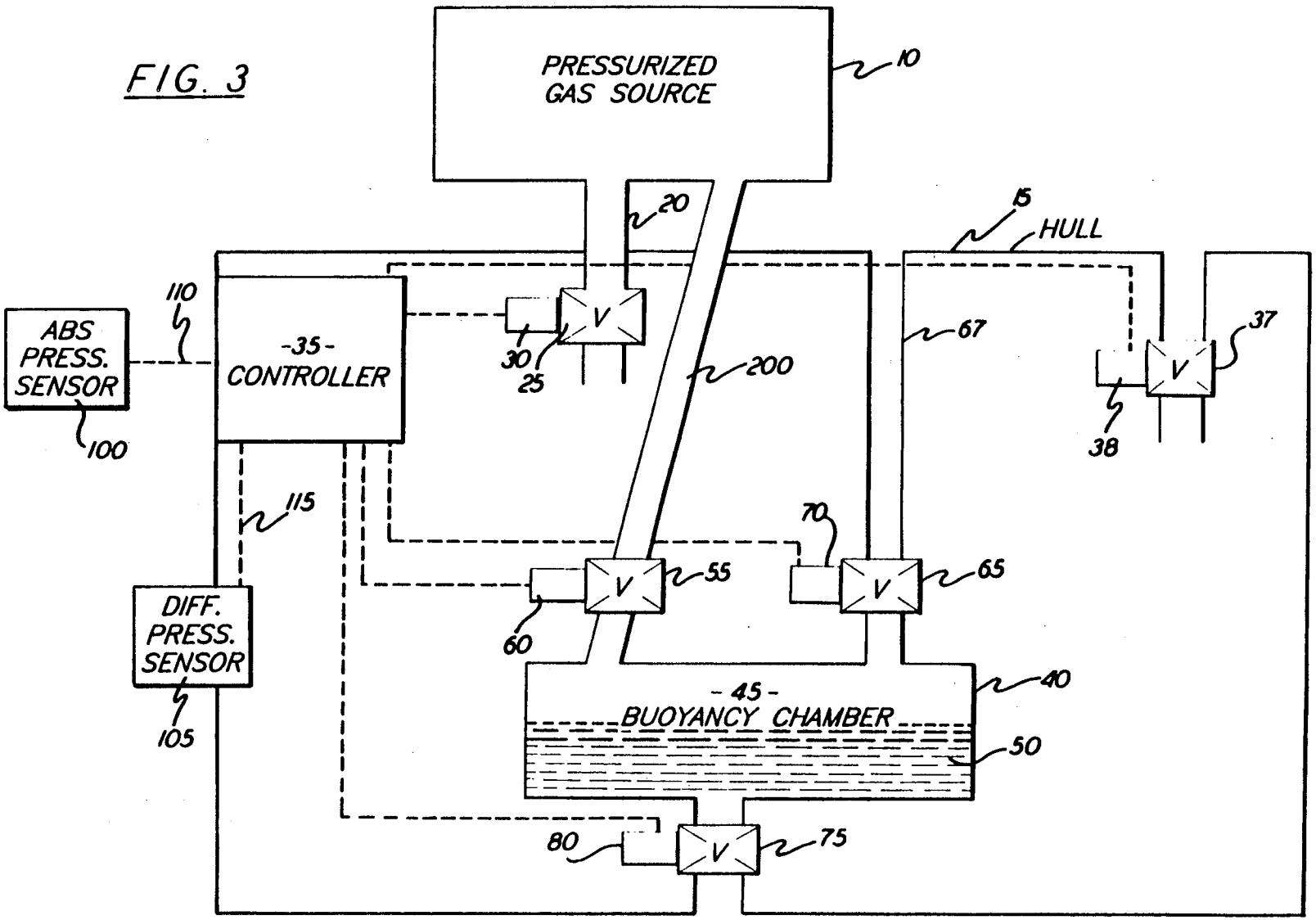
FIG. 3 is a schematic representation of an alternate embodiment of the vehicle.

Referring to FIG. 3, reference volume 85 and differential pressure sensor 120 may be dispensed with for simplicity. The reference pressure for sensor 105 then becomes the internal pressure of chamber 15. In this case, when the vehicle locates itself at the desired control depth and valves 55, 65 and 75 are closed, differential pressure sensor 105 senses the difference in pressure between the atmosphere internally of the vehicle and the water pressure surrounding the vehicle. Conduit 200 connects valve 55 to gas source 10 thereby preventing the pressurization of buoyancy chamber 40 through valve 55 from disturbing the reference atmosphere within enclosure 15.

It is, thus seen that the vehicle of the present invention is capable of operation at predetermined depths without air pumps, vertical thrusters or other mechanical apparatus for controlling vehicle buoyancy. The rigid and normally sealed buoyancy chamber prevents slight errors in vehicle depth from amplifying themselves due to a positive feedback characteristic of water pressure on the vehicle. This lack of positive feedback in excursions from the desired depth allows the depth to be accurately controlled with minimal quantities of buoyancy gas thereby allowing the vehicle to operate for extended periods of time with reduced quantitites of gas. The arrangement of the gas and water valves by which air and water are admitted into and discharged from the buoyancy chamber allow the buoyancy thereof to be accurately controlled with an uncomplicated construction.

Having thus described the invention, what is claimed is:

1. A vehicle capable of hoverable submersion in a body of water: said vehicle being characterized by:

a rigid walled buoyancy chamber accommodating controlled volumes of a gas and water therein, the ratio of said gas volume to said water volume determining the buoyancy of said chamber;

a source of pressurized gas;

a first valve communicating with said gas source and said chamber for controlling the admission of said gas from said source thereof to said chamber;

a second valve communicating with said chamber proximally to an upper portion thereof for controlling the venting of said gas from said control chamber to said body of water;

a third valve communicating with said chamber proximally to a lower portion thereof for controlling the admission of water into, and the discharge of water from said chamber;

a first actuator, said first actuator opening said first valve to increase the volume of gas within said chamber to increase the buoyancy of said vehicle;

a second actuator, said second actuator opening said second valve to vent said gas from said chamber to decrease the buoyancy of said vehicle;

a third actuator, said third actuator opening said third valve whenever said first or second valves are opened thereby providing for the discharge of water from, and the admission of water into said chamber, said third actuator closing said third valve when said first and second valves are closed to maintain constant buoyancy with a resultant rigid, sealed buoyancy chamber;

means sensing the pressure of the water immediately surrounding said vehicle;

control means operably connected to said pressure sensing means and responsive thereto;

a fourth actuator operably connected to said control means and being controlled thereby in response to the output thereof;

a hull enclosing a substantial portion of said vehicle; and the interior of said hull being in fluid communication with said source of pressurized gas through a fourth, pressure regulating valve, said fourth actuator operating said pressure regulating valve to control the pressure of said gas discharged from said source thereof in response to variations in vehicle depth, thereby maintaining a predetermined pressure in said hull, slightly higher than that of the surrounding water for enhancement of the structural integrity of said vehicle.

2. The vehicle of claim 1 characterized by:

a fifth valve disposed in a wall of said hull; and a fifth actuator, said fifth actuator opening said fifth valve for the venting of said gas from said hull to said boy of water when gas pressure in said hull exceeds said predetermined hull operating pressure.

3. The vehicle of claim 1 characterized by an inlet of said first valve communicating, without flow impediment, with the interior of said hull.

* * * * *